United States Patent [19]

Rodocker

[11] Patent Number: 4,590,740

[45] Date of Patent: May 27, 1986

[54] CONTAINER STERILIZATION APPARATUS AND METHOD

[75] Inventor: Frank A. Rodocker, Milford, Mich.

[73] Assignee: Ex-Cell-O Corporation, Troy, Mich.

[21] Appl. No.: 769,650

[22] Filed: Aug. 27, 1985

Related U.S. Application Data

[63] Continuation of Ser. No. 514,373, Jul. 15, 1983, abandoned.

[51] Int. Cl.[4] ..... B65B 55/04

[52] U.S. Cl. ..... 53/426; 53/167; 53/565

[58] Field of Search ..... 53/167, 425, 426, 563, 53/565; 493/163, 165; 422/302–304

[56] References Cited

U.S. PATENT DOCUMENTS

| | | | |
|---|---|---|---|
| 2,697,313 | 12/1954 | Wilcox | 53/426 |
| 3,383,831 | 5/1968 | Goldsmith et al. | 53/551 X |
| 3,566,575 | 3/1971 | Lisiecki | 53/426 |
| 3,890,765 | 6/1975 | Farfaglia et al. | 53/563 |
| 4,375,145 | 3/1983 | Mosse et al. | 53/266 R X |
| 4,456,118 | 6/1984 | Kauffman et al. | 53/565 X |
| 4,506,491 | 3/1985 | Joosfen et al. | 53/426 |

FOREIGN PATENT DOCUMENTS

| | | | |
|---|---|---|---|
| 2136934 | 1/1973 | Fed. Rep. of Germany | 53/167 |

*Primary Examiner*—John Sipos
*Assistant Examiner*—Steven P. Weihrouch
*Attorney, Agent, or Firm*—John P. Moran

[57] ABSTRACT

A sterilization apparatus and method for sterilizing the interiors of paperboard containers, wherein such apparatus and method are operative prior to the container being mounted on a mandrel assembly on which the container bottom closures are formed, closed and sealed. This is accomplished by providing nebulizing means for communicating a suitable sterilant fog through and onto the inside surfaces of the carton blank immediately after it has been removed from a magazine and opened into a four-sided tubular shape, thereby greatly increasing the total interior sterilizing time available prior to the container being filled, as compared to conventional sterilization processes which are operative after the bottom panels of the carton have been closed and sealed.

3 Claims, 7 Drawing Figures

CONTAINER STERILIZATION APPARATUS AND METHOD

This application is a continuation of application Ser. No. 514,373, filed 7-15-83, now abandoned.

TECHNICAL FIELD

This invention relates generally to sterilization techniques and, more specifically, to an improved apparatus and method for sterilizing thermoplastic coated, liquid carrying paperboard containers prior to their being filled with a liquid and sealed on a conventional forming, filling and sealing machine.

BACKGROUND ART

It is desirable from a marketing standpoint to increase the storage or shelf life of various comestible products. This is accomplished by employing a sterilization process in conjunction with the forming, filling and sealing operations. Heretofore, sterilization of thermoplastic coated, liquid carrying paperboard containers has typically been accomplished on the forming, filling and sealing machine at a location between the station where the bottom formed container is stripped from an indexing mandrel and a station downstream thereof where the container is filled with a liquid, such as milk or juice. Such an arrangement is shown and described in Lisiecki U.S. Pat. No. 3,566,575, issued Mar. 2, 1971.

It is also known to use a sterilization apparatus and process wherein a channel is formed through the length of each mandrel of a typical indexing sprocket and mandrel assembly, with the channel communicating with openings and compartments formed in the hub of the indexing sprocket and mandrel assembly, such that as each mandrel reaches the 6:00 position, there is communication with a line leading from a generator which is capable of continuously producing a chlorine dioxide or hydrogen peroxide fog, thereby conveying such fog through the compartment and respective channels to the interior of each container as the latter is being mechanically stripped from the mandrel upon which it is slidably mounted. Such an arrangement is shown and described in Joosten and Davis Patent application Ser. No. 369,940, filed Apr. 16, 1982.

DISCLOSURE OF THE INVENTION

A general object of the invention is to provide improved sterilization apparatus and process which are highly efficient and compatible with existing forming, filling and sealing machines.

Another object of the invention is to provide improved sterilization apparatus and process which are functional in conjunction with the indexing sprocket and mandrel assembly currently included on many models of forming, filling and sealing machines.

A further object of the invention is to provide a sterilization apparatus and process wherein an atomizing or nebulizing nozzle is located on a forming, filling and sealing machine so as to dispense a suitable sterilant in a fog state into and through a tubular, open ended carton blank, just after the blank has been removed in a folded-over, flattened state from a magazine and opened in the usual manner, and just prior to and during the time that the tubular blank is being slidably mounted on a mandrel of a forming, filling and sealing machine.

These and other objects and advantages of the invention will be apparent when reference is made to the following description and accompanying drawings.

BEST MODE OF CARRYING OUT THE INVENTION

Figure 1:
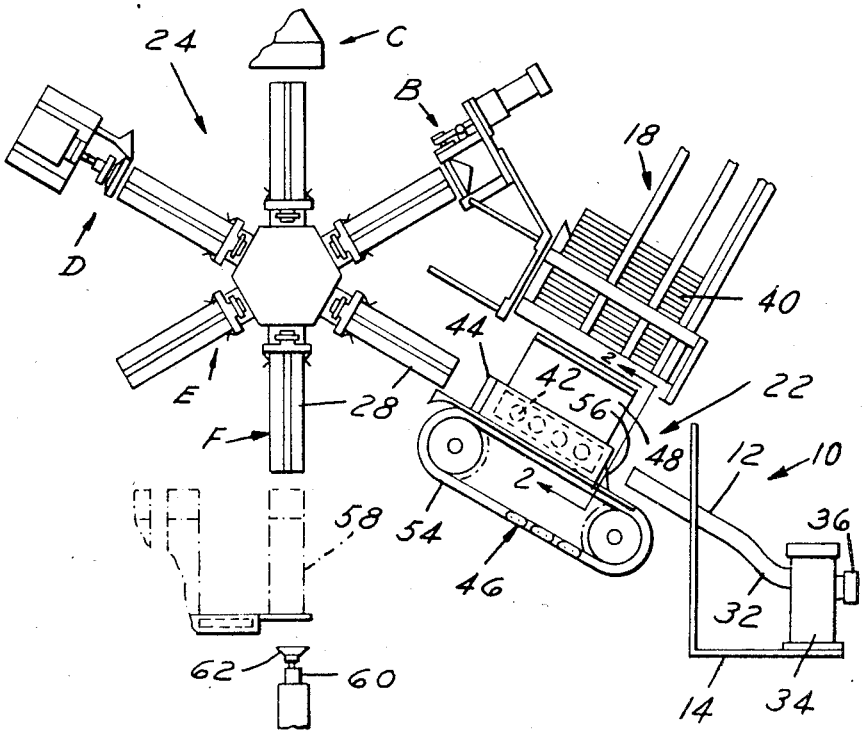
FIG. 1 is a fragmentary side elevational view of a forming, filling and sealing machine embodying the invention.
Figure 2:
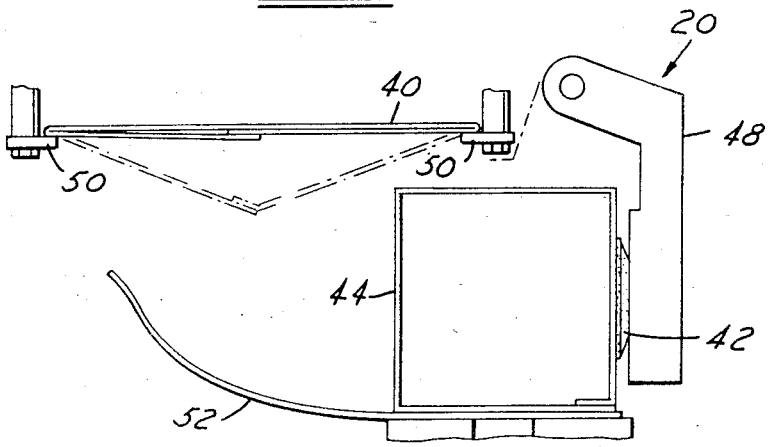
FIG. 2 is an enlarged, framentary cross-sectional view taken along the plane of the line 2—2 of FIG. 1, and looking in the direction of the arrows.
Figure 3:
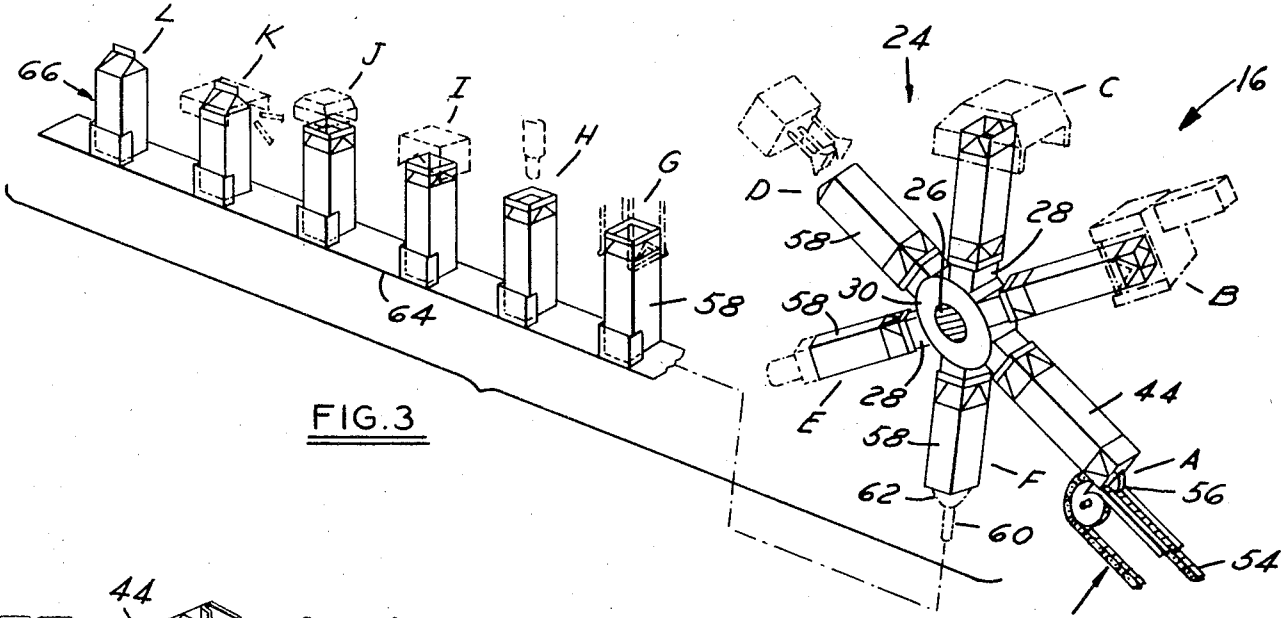
FIG. 3 is a perspective schematic view illustrating typical operations performed on a container as it travels through a forming, filling and sealing machine.

Referring now to the drawings in greater detail, FIGS. 1–3 illustrate a sterilization arrangement 10, including a nebulizing nozzle 12 mounted on the frame 14 of a conventional forming, filling and sealing machine, represented as 16. The latter includes a magazine 18, a blank feeder assembly 20, a blank loader assembly 22, and an indexing mandrel assembly or bottom closing mechanism 24 mounted on a drive shaft 26. The assembly 24 includes six equally spaced mandrels 28 extending radially from a hub 30 mounted on the drive shaft 26. Connected to the nebulizing nozzle 12 is a line 32 which leads from a suitable generator 34 connected via lines 36 to a source (not shown) of a suitable sterilizing fluid under pressure.

The feeder and loader assemblies 20 and 22 are adapted generally to withdraw blanks successively from the magazine 18, erect them into an open-ended tubular form, and then load them onto respective mandrels 28 of the bottom closing mechanism 24. For such purpose, these mechanisms are driven in synchronism with each other from the main drive of the machine 16.

Figures 4A, 4B, 4C, 4D:
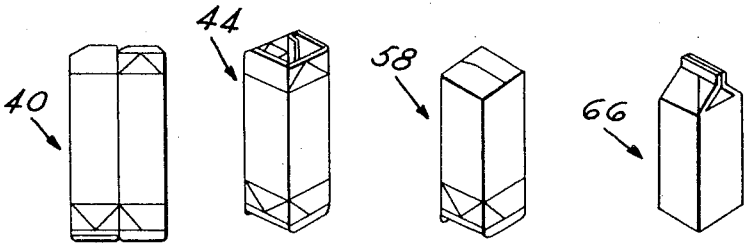
FIG. 4A is an illustration of a typical folded-over, flattened and side seamed container blank suitable for being loaded into the magazine of a forming, filling and sealing machine.
FIG. 4B is a perspective view of the container blank shown in FIG. 4A in open-ended, tubular form as it appears prior to and while being mounted on a mandrel at Station A in FIG. 3.
FIG. 4C is a perspective view of the container after the bottom closure panels have been sealed at station D in FIG. 3.
FIG. 4D is a perspective view of a filled and sealed container after passing through to the discharge station of the machine, represented as L in FIG. 3.

Conventionally, a thermoplastic coated paperboard container blank 40 (FIG. 4A) is removed by vacuum pick-up or suction cups 42 (FIG. 2) from the magazine 18 (FIG. 1), causing the blank 40 to open into a four-sided tube 44 (FIG. 4B), and deposited upon a small conveyor 46 (FIG. 1). The conveyor 46 moves the tube 44 toward and onto one of the mandrels 28 at a load station A located in the 4:00 o'clock position, as viewed in FIG. 1. The nebulizing nozzle 12 is located adjacent the rear end of the tube 44, aligned with the longitudinal axis thereof.

Typically, the blank feeder assembly 20 (FIG. 2) comprises a pivotally mounted gate member 48 adapted to swing through an angle of about 90 degrees between the two positions shown in FIG. 2. A plurality of the vacuum pick-up cups 42 are mounted on the gate member 48, adapted to engage a side panel of the lowermost blank 40 in the magazine 18. Outward movement of the gate member 48 after engagement with a blank causes such blank to commence opening, as shown in FIG. 2, and snap past the stop abutments 50. With further outward movement of the gate, the left-hand lateral edge of the blank is cammed against a fixed arcuate guide 52, opening the blank still further until it reaches its fully opened position at the end of the arcuate travel of the gate member 48, whereupon it is deposited on the small conveyor 46.

The blank loader assembly 22 typically comprises an endless chain 54 having an outwardly projecting finger 56 formed thereon. The chain is arranged to move the finger through a stroke generally parallel to the side walls of the squared blank 44. In the course of such movement, the finger engages the rear outer edge of a bottom closure panel. When this occurs, the vacuum cups 42 on the gate member 48 release the blank and the latter is urged along fixed guides (not shown) until it telescopes over an aligned mandrel 28 of the indexing mandrel assembly 24.

Once loaded, the mandrel assembly 24 indexes from the load station A to a bottom panel pre-breaker station B in the 2:00 o'clock position, prior to indexing to a bottom panel heat station C in the 12:00 o'clock position. The next index is to the bottom panel tuck and pressure station D at 10:00 o'clock, followed by transfer to a station E which may be used as a second pressure station at 8:00 o'clock, and finally indexing to a discharge or stripper station F at 6:00 o'clock as a bottom-sealed container 58 (FIG. 2C). The stripping of the bottom-sealed container 58 from each successive mandrel 28 is effected by a reciprocally actuated mechanical stripper 60 having a rubber vacuum cup 62 mounted on the end thereof for engagement with the closed and sealed bottom of the container 58.

In general, once the sealing of the bottom closure is completed, the container 58 is pulled downwardly by the mechanical stripper 60 from the mandrel 28 at station F and deposited on a suitable conveyor, represented at 64 in FIG. 1. The open-topped container 58 is thereafter acted upon at a top pre-breaker station G, such pre-breaking serving to facilitate the subsequent folding and sealing of the top closure. The container 58 is next conveyed to a filling station H where a measured volume of a product, such as juice, is dispensed into the open end of the container. The container 58 is then caused to encounter a top partial folding or tucking station I, prior to indexing to a heating station J which heats the thermoplastic top closure panels just prior to transfer of the container to a sealing station K where the top closure panels are brought together with a combined pressure and cooling action to become tightly sealed into a completed gable top container 66, prior to delivery to a discharge station L.

After each blank 40 is removed from the magazine 18 and opened into the tubular blank 44 form, as it is being conveyed by the small conveyor 64 toward the mandrel 28, the axially aligned nebulizing nozzle 12 serves to dispense a sterilant fog into the tube, substantially along the entire inside surfaces of the four sides thereof. Secondarily, the fog strikes the bottom of the mandrel 28 and bounces or swirls back into the tube 44 to further settle onto the four interior wall surfaces. At the bottom panel heat station C, the heat therefrom is believed to enhance the action of a sterilant, such as chlorine dioxide, within the tube 44.

In the event that hydrogen peroxide is used as the sterilizing agent, it may be necessary to include a drying or heating unit (not shown) between stations G and H, which would serve to remove the hydrogen peroxide residue from inside the container prior to the filling of the container with the desired product at station H.

INDUSTRIAL APPLICABILITY

It should be apparent that the inventive sterilization apparatus provides an improved means for initiating the sterilization of carton blanks once formed into a tube, prior to being formed into bottom-sealed containers, rather than after the bottom forming operation at a remote station along a forming, filling and sealing machine, thereby substantially increasing the sterilizing time allotted to each carton.

It may be further apparent that such sterilization apparatus serves to intermittently distribute the chlorine dioxide or hydrogen peroxide fog throughout any machine enclosure (not shown) in which the indexing mandrel assembly 24 is mounted while the tubular blank 44 is being mounted on a mandrel 28. This feature thus serves to continuously sterilize the complete mandrel assembly 24 all the while that it is operational.

While but one embodiment of the invention has been shown and described, other modifications thereof are possible.

The embodiments of the invention in which an exclusive property or privilege is claimed are defined as follows:

1. A sterilization apparatus for four-sided paperboard container blanks stored in a magazine of a forming, filling and sealing machine in a folded-over, flattened state with their free edges sealed together, said machine including an indexing mandrel assembly; suction means for removing said folded-over, flattened blanks one-at-a-time from said magazine; means for opening each of said blanks into a four-sided, open-ended tubular blank; and means for placing such tubular blank on one of its sides on conveyor means; said apparatus comprising a source of sterilant under pressure; a generator for receiving and dispensing said sterilant in a fog state; and a fixed nebulizing nozzle operatively connected to said generator and mounted on said machine in axial alignment with each respective tubular blank on said conveyor means for dispensing said sterilant fog into and through the tubular blank through the adjacent open end thereof just prior to and concurrent with said tubular blank being moved toward and mounted on an axially aligned mandrel of said indexing mandrel assembly by said conveyor means, to thereby provide a maximum sterilizing time for each blank and serve to sterilize said indexing mandrel assembly.

2. A method for producing a sterilized paperboard container to be filled with a liquid, in which a folded-over, flattened four-sided blank with its free edges sealed together is pulled by suction means from the bottom of a stack of blanks in a magazine on a forming, filling and sealing machine; opened into an open-ended tubular blank; and placed on one of its sides on conveyor means for being conveyed toward and onto a mandrel of an indexing mandrel assembly, characterized by drawing a sterilant from a source under pressure into a nebulizing nozzle, and dispensing said sterilant in a fog state via the nozzle into the rear open end of and through the tubular blank while the blank is being conveyed by said conveyor means toward and onto said mandrel to thereby provide a maximum sterilizing time for each blank and serve to sterilize said indexing madel assembly.

3. On a forming, filling and sealing machine including a magazine for holding flattened, four-sided paperboard container blanks having their free cut edges sealed together, an indexing mandrel assembly including a plurality of radially extending, equally spaced mandrels, means for closing and sealing one end of each tubular blank mounted on respective mandrels, conveyor means operative intermediate said magazine and said respective mandrels, and suction from opening means for pulling each flattened blank from said magazine, opening such flattened blank into a tubular blank, and placing each tubular blank on one of its sides on said conveyor means; a method for sterilizing each tubular blank while being conveyed by said conveyor means toward and onto said respective mandrels, said method comprising the following steps:

(a) Providing a nebulizing nozzle on said machine below said magazine and behind said conveyor means, with the axis of the nozzle aligned with the line that the axis of each tubular blank assumes while being conveyed by said conveyor means;

(b) Providing a connection from said nozzle to a source of sterilant under pressure and cooperating generating means for receiving and dispensing said sterilant in a fog state; and (c) Dispensing said sterilant in a fog state by said nozzle into and through each of said tubular blanks and onto the interior surface thereof all the while each such blank is being conveyed by said conveyor means toward and onto each respective mandrel to thereby provide a maximum sterilizing time for each blank and serve to sterilize said indexing mandrel assembly.

* * * * *